US009103164B2

(12) United States Patent
In

(10) Patent No.: US 9,103,164 B2
(45) Date of Patent: Aug. 11, 2015

(54) AIR HAMMER FOR A BORING MACHINE

(75) Inventor: Suk Sin In, Gwangju (KR)

(73) Assignee: HANJIN D&B CO., LTD., Gwangju (KR)

( * ) Notice: Subject to any disclaimer, the term of this patent is extended or adjusted under 35 U.S.C. 154(b) by 560 days.

(21) Appl. No.: 13/514,267

(22) PCT Filed: Dec. 22, 2009

(86) PCT No.: PCT/KR2009/007692

§ 371 (c)(1),
(2), (4) Date: Jun. 28, 2012

(87) PCT Pub. No.: WO2011/078421

PCT Pub. Date: Jun. 30, 2011

(65) Prior Publication Data

US 2012/0261151 A1 Oct. 18, 2012

(51) Int. Cl.
*B25D 9/00* (2006.01)
*E21B 4/14* (2006.01)

(52) U.S. Cl.
CPC .... *E21B 4/14* (2013.01); *B25D 9/00* (2013.01)

(58) Field of Classification Search
CPC ..... B25D 9/00; B25D 9/12; B25D 9/26; E02D 7/06
USPC ..... 173/114, 200, 204; 175/296
See application file for complete search history.

(56) References Cited

U.S. PATENT DOCUMENTS

| | | | | | |
|---|---|---|---|---|---|
| 4,133,393 | A | * | 1/1979 | Richards | 173/64 |
| 4,534,422 | A | * | 8/1985 | Rear | 173/206 |
| 4,932,483 | A | * | 6/1990 | Rear | 175/296 |
| 5,205,363 | A | * | 4/1993 | Pascale | 173/17 |
| 5,305,837 | A | * | 4/1994 | Johns et al. | 175/61 |
| 5,322,136 | A | * | 6/1994 | Bui et al. | 175/65 |
| RE36,166 | E | * | 3/1999 | Johns et al. | 175/61 |
| RE36,848 | E | * | 9/2000 | Bui et al. | 175/65 |

FOREIGN PATENT DOCUMENTS

| | | | |
|---|---|---|---|
| EP | 0507610 | A1 | 10/1992 |
| KR | 10-2005-0094702 | A | 9/2005 |
| KR | 10-2006-0106388 | A | 10/2006 |
| WO | WO 99/66167 | A1 | 12/1999 |

* cited by examiner

*Primary Examiner* — Michelle Lopez
(74) *Attorney, Agent, or Firm* — Lexyoume IP Meister, PLLC

(57) ABSTRACT

An air hammer for a boring machine includes a main body, a first bushing member, a second bushing member installed at an end on the opposite side of the main body, a bit unit installed at an end of the second bushing member, a piston hammer, a pneumatic discharge part formed at the top end of the second bushing member, and a pneumatic pressure distribution part formed on the piston hammer.

2 Claims, 7 Drawing Sheets

AIR HAMMER FOR A BORING MACHINE

TECHNICAL FIELD

The present invention relates to a boring machine, and more particularly, to an air hammer for a boring machine, which is installed at an end of a rod to perform excavation.

BACKGROUND ART

In general, a boring machine for perforating the ground is based on a technique of simply circulating a bit (Oscillating method), a technique of not only circulating a bit or a ball cutter but also pressurizing the same (Reverse Circulation Drilling method: ROC), and so on. According to the oscillating method, in a state in which a standard casing having a diameter of 800 to 3000 mm is clamped by a hydraulic chuck, boring is performed by oscillating a cylinder installed rotatably in a left-right direction. According to the ROC method, the ground is bored using a drive rod having a rotary bit or ball cutter installed at its end portion by rotating the bit or ball cutter. The oscillation method can cope with a soft ground condition, that is, excavation is properly carried out through soft ground such as soil. However, for a hard-boring operation, it is necessary to demolish rocks under the ground by dropping a large-sized hammer, requiring additional equipment such as a pile driver.

Meanwhile, in the RCD method, which is an advanced method compared to the oscillation method from the viewpoint of boring capacity, a soil layer is first dug using an oscillator or a rotator, both a soft rock layer and a hard rock layer are dug by rotating drill rod a specially designed bit attached to its end portion, and air-suctioning circulating water and cloven rocks through a drill rod pipe, followed by hoisting the rocks to the surface of the ground. The RCD method is essentially employed in large-diameter cast-in-place and top-down method for a foundation work.

Examples of an air hammer for performing excavation are disclosed in U.S. Pat. Nos. 3,941,196, 0,430,554, and 3,991,834.

Since the conventional air hammer is moved downward to performing a striking action in a state in which it is separated from a guide, a vibration may occur while moving up and down. In particular, the air is rapidly cooled at a discharge outlet of the chamber due to adiabatic expansion, causing cracks. In addition, since there is no change in the air for upward moving the piston at the top dead center when the air hammer is moved upward, the shock may become increased. In addition, since a reaction force may become increased when the air hammer collides with the bit unit, the striking force of the bit unit may not be uniform.

An example of a boring machine using a crane is disclosed in Korean Patent No. 10-0372049.

DISCLOSURE OF INVENTION

Technical Problems to Be Solved by the Invention

In order to overcome the above-mentioned shortcomings, the present invention provides an air hammer for a boring machine, which can reduce a vibration of a piston due to a rocking of the piston by supporting top and bottom portions of a piston hammer.

In addition, the present invention provides an air hammer for a boring machine, which can prevent a piston from being brittle when a piston is rapidly cooled due to adiabatic expansion of air when the air is supplied to upper and lower chambers through a piston hammer and can prevent cracks from being generated.

Further, the present invention provides an air hammer for a boring machine, which can delay a time required to reach the maximum pressure when a piston hammer is moved up and down.

Technical Solutions to the Problems of the Invention

According to an aspect of the invention, there is provided an air hammer for a boring machine is provided, including: a main body including a hollow portion; a socket coupled to a side of the main body; a first bushing member including a sealing part coupled to the main body and a piston guide part extending from the sealing part in parallel with a lengthwise central axis of the main body and defining an air supply passage and discharge holes in an outer surface thereof to communicate with the air supply passage; a second bushing member installed at an end on the opposite side of the main body; a bit unit installed at an end of the second bushing member; a piston hammer, top and bottom ends of which are supported by the guide part and the second bushing member so as to be moved up and down, the piston hammer having a guide hole formed therethrough in the lengthwise direction and partitioning a main body compartment between the first and second bushing members into first and second chambers; a passage part recessed at the top end of the second bushing member to discharge air in the second chamber when the piston hammer is moved upward; and a pneumatic pressure distribution part formed on the piston hammer to selectively supply to the first or second chamber, in conjunction with the socket, the pneumatic pressure supplied through a pneumatic pressure supply passage and the discharge holes of the piston guide part of the first bushing member.

In the present invention, each of the discharge holes has opposite-end sectional areas gradually decreasing away from its center to its top and bottom sides.

The pneumatic pressure distribution part may include first and second distribution grooves spaced apart a predetermined distance from each other on the inner circumferential surface of a guide hole formed lengthwise; the first distribution groove may be connected to a first distribution hole penetrating the piston hammer from the first distribution groove to the outer circumferential surface of the piston hammer, the first distribution hole formed at a portion on the outer circumferential surface of the piston hammer to be connected to a connection groove to communicate with the inner circumferential surface of the main body, and the connection groove connected to the second chamber by a first distribution recess part formed on the outer circumferential surface of the piston hammer; and the second distribution groove may be connected to a second distribution hole penetrating the piston hammer from the second distribution groove to the top end of the piston hammer, the second distribution hole formed on the outer circumferential surface of the piston hammer to be connected to a second distribution recess part communicating with the first chamber.

An enlarged opening part may be formed at outlets of the first and second distribution recess parts, the enlarged opening part having sectional areas gradually increasing.

According to another aspect of the invention, there is provided an air hammer for a boring machine, including: a main body including a hollow portion; a socket coupled to a side of the main body; a first bushing member including a sealing part coupled to the main body and a piston guide part extending from the sealing part in parallel with a lengthwise central axis of the main body and defining an air supply passage and discharge holes in an outer surface thereof to communicate with the air supply passage; a second bushing member installed at an end on the opposite side of the main body; a bit unit installed at an end of the second bushing member; a piston hammer, a bottom end of which is slidably supported by the second bushing member so as to be capable of sliding along the piston guide part and the second bushing member, the piston hammer having a guide hole formed therethrough in the lengthwise direction and partitioning a main body compartment between the first and second bushing members into first and second chambers; an air discharge part installed at the top end of the second bushing member to discharge air in the second chamber when the piston hammer is moved upward; and a pneumatic pressure distribution part formed on the piston hammer to supply pneumatic pressure to the second chamber when the piston is moved downward and to the first chamber when the piston is moved upward.

Advantageous Effects

In the air hammer for a boring machine according to the present invention, when the piston hammer is moved up and down, the top and bottom ends of the piston are supported, thereby preventing a striking force from being distributed due to vibration of the piston hammer and reducing an inertial force when the piston hammer is moved upward.

In addition, when a pneumatic pressure is supplied to first and second chambers, the air is rapidly cooled at discharge outlets of first and second pneumatic pressure supply passages due to adiabatic expansion, thereby preventing the piston hammer from being damaged due to brittleness.

BRIEF DESCRIPTION OF THE DRAWINGS

The objects, features and advantages of the present invention will be more apparent from the following detailed description in conjunction with the accompanying drawings, in which.

BEST MODE FOR CARRYING OUT THE INVENTION

Hereinafter, a bearing unit according to an embodiment of the present invention and a protection cover for a grass mower using the bearing unit will be described in detail with reference to the accompanying drawings.

Figure 1:
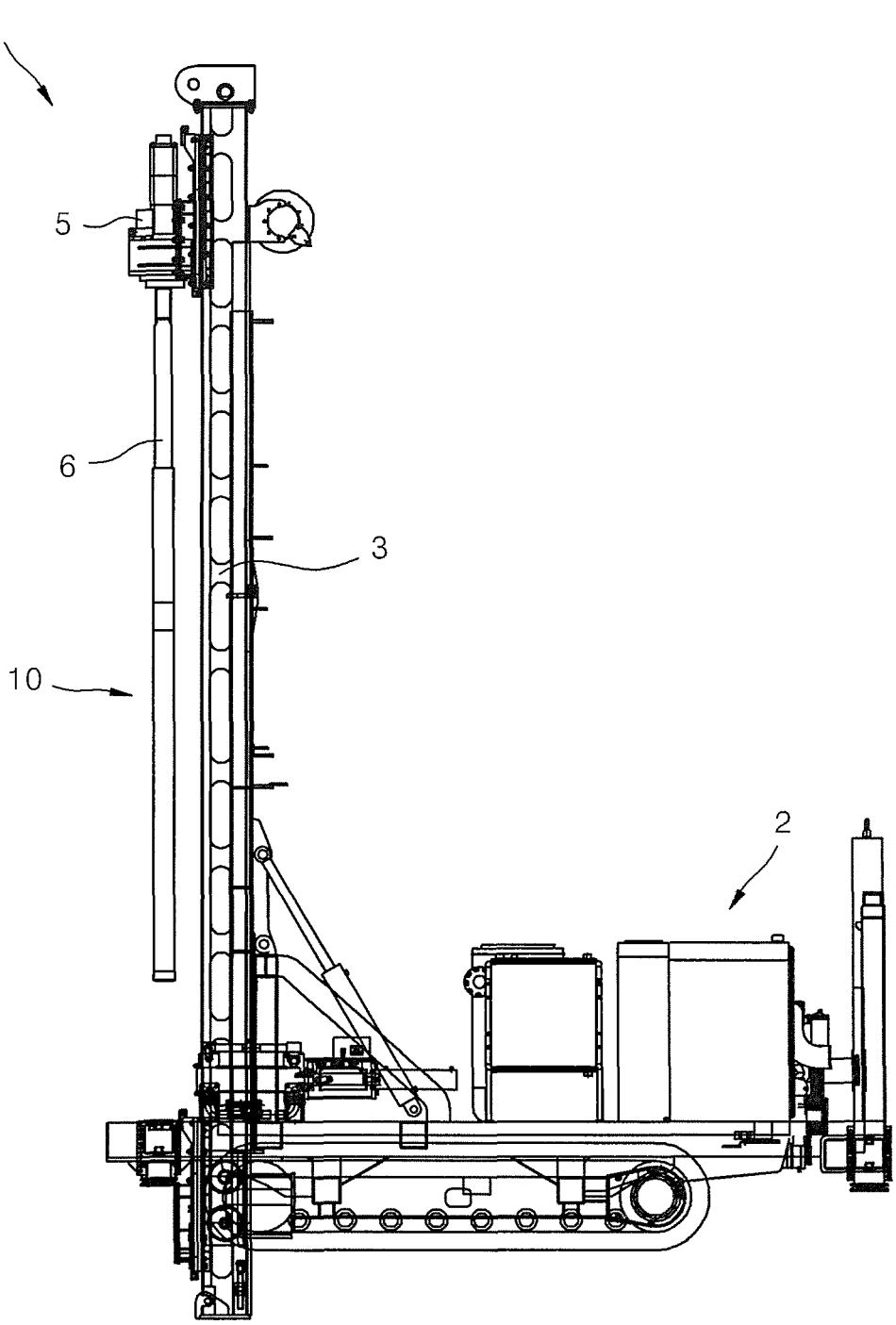
FIG. 1 is a schematic side view of a boring machine according to the present invention.
Figure 2:
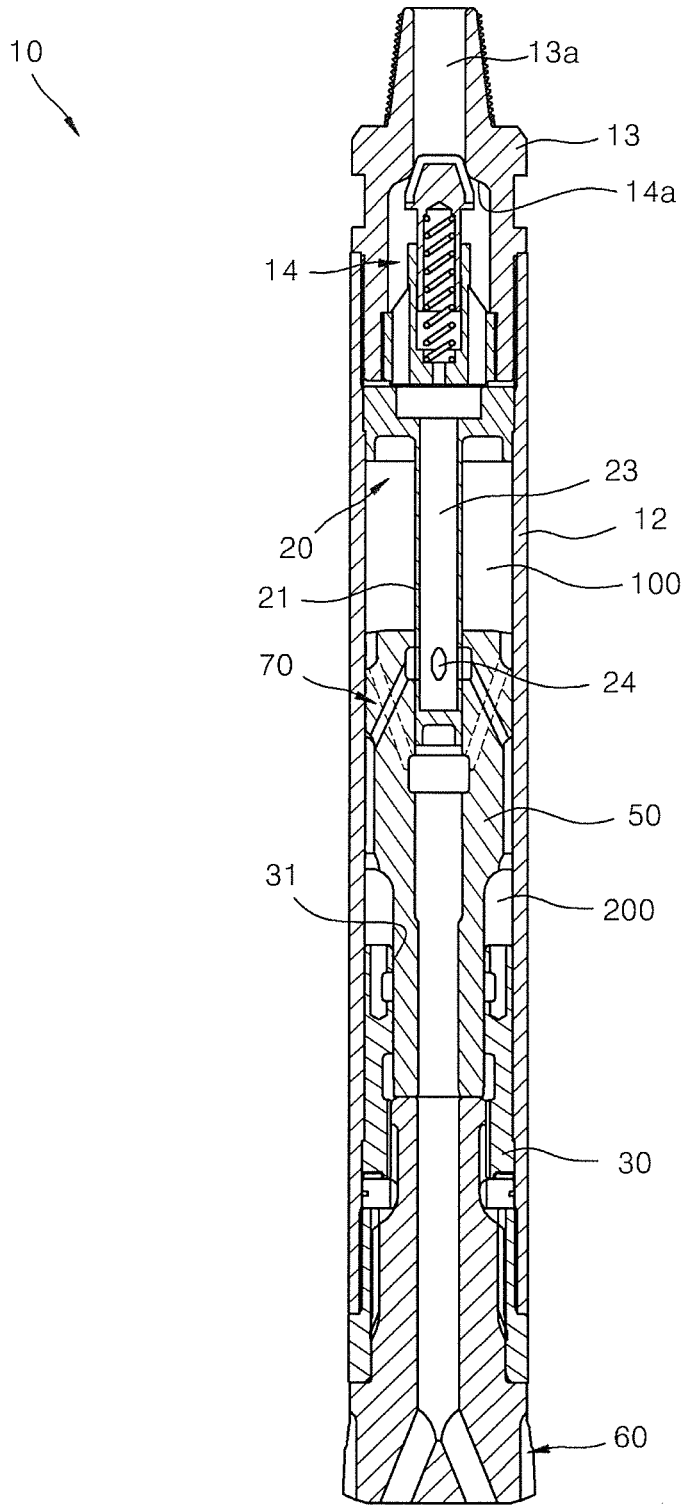
FIG. 2 is a cross-sectional view of an air hammer according to the present invention.

The air hammer according to the present invention is installed at a drive rod of a boring machine and supplies a bit with a striking force for performing excavation, and one example embodiment thereof is illustrated in FIGS. 1 and 2.

Referring to FIGS. 1 and 2, the boring machine 1 includes a lead 3 installed to be perpendicular to a machine body 2, a head part 5 guided by the lead 3 so as to be moved up and down, and an air hammer 10 coupled to a drive shaft of the head part 5 and installed at an end of a drive rod 6 so as to be moved up and down and to be rotated. Although not shown, a compressor for supplying the air hammer with a pneumatic pressure through the drive rod is installed in the machine body 2.

The air hammer 10 for the boring machine 1 includes a main body 12 including a first hollow portion 11, a socket 13 coupled to a top end of the main body 12, a first bushing member 20 installed in the main body 12 provided next to the socket 13 and having a piston guide part 21, a second bushing member 30 installed at an end of the main body 12, a bit unit 60 installed at a bottom end of the second bushing member 30 and performing excavation, and a piston hammer 50 installed to be capable of sliding along the piston guide part 20, the piston hammer 50 having a guide hole 51 formed therethrough in the lengthwise direction, the bottom end thereof being slidably supported by a hollow guide part 31 formed in the second bushing member 30, and partitioning a main body compartment between the first and second bushing members 20 and 30 into first and second chambers;

In addition, the air hammer 10 may further include a pneumatic pressure distribution part 70 formed on the piston hammer 50 to selectively supply, in conjunction with the socket 13, to the first or second chamber 100 or 200, the pneumatic pressure supplied through the piston guide part 21 of the first bushing member 20, so as to move up and down the piston hammer 50.

The aforementioned air hammer 10 for the boring machine according to the present invention will now be described in more detail.

In the air hammer 10 for the boring machine according to the present invention, the main body 12 is shaped of a cylindrical tube. The drive rod 6 and the main body 12 preferably have the same diameter. The socket 13 installed at an upper portion of the main body 12 is coupled to an end of the drive rod 6. The socket 13 has a thread coupling part formed on its outer circumferential surface and a first pneumatic pressure supply passage 13*a* formed in the lengthwise direction to supply high pressure through the hollow portion of the drive rod 6. A check valve 14 is installed at a lower portion of the socket 13 to prevent the pneumatic pressure supplied to the first bushing member 20 through the first pneumatic pressure supply passage 13*a* from flowing backward. The check valve 14 includes a seat member 14*a* formed at the socket 12, a check valve member 14*b* contacting and coupled to the sheet member 14*a* to blocking the seat member 14*a*, an elastic member 14*c* elastically biasing check valve member 14*b* coupled to the socket 13 in an upward direction, and a stopper 14*d* coupled to the socket 13 to support the elastic member 14*c*. The stopper 14*d* has a throughhole 14*e* for supplying to the first bushing member 20 the pneumatic pressure supplied through the first pneumatic pressure supply passage 13*a*.

Figure 3:
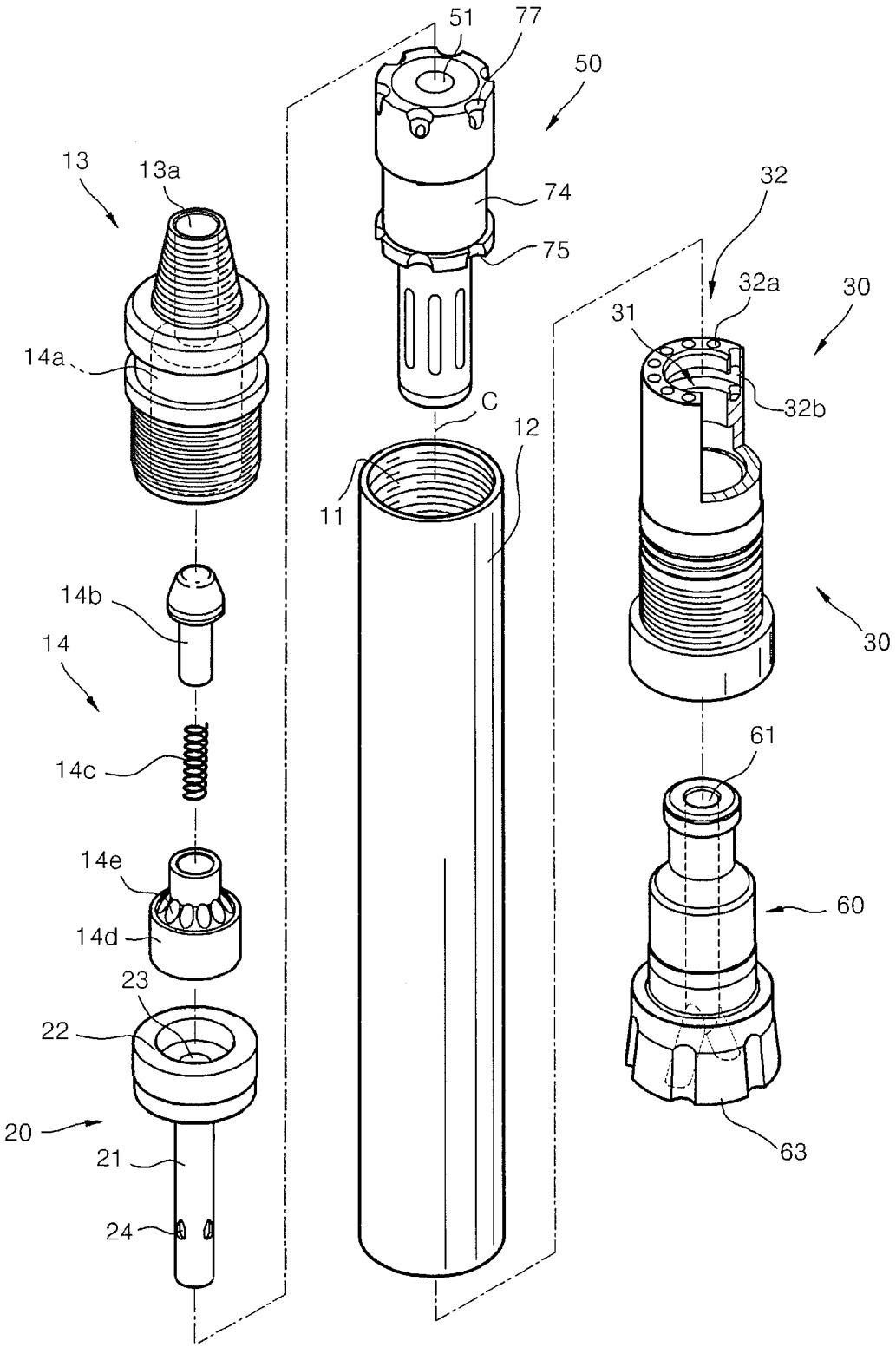
FIG. 3 is a partial perspective view of the air hammer shown in FIG. 2.
Figure 4:
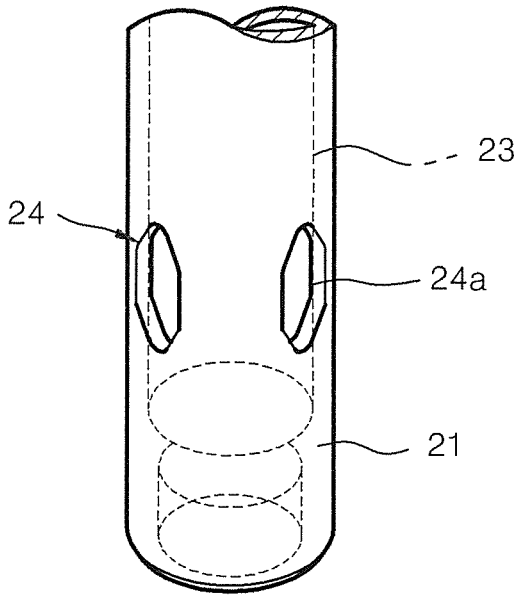
FIG. 4 is an extracted perspective view of a first bushing member.

The first bushing member 20 is installed inside the main body 12 installed at the lower portion of the socket 13 and supplies the pneumatic pressure supplied through the first pneumatic pressure supply passage 13*a* of the socket 13 to a pneumatic pressure distribution part 70 provided in the piston hammer 50, as shown in FIGS. 2 to 4.

The first bushing member 20 includes a sealing part 22 supported to the main body 11, and a piston guide part 21 extending to the bit unit 60 positioned below the sealing part 22 to guide the piston hammer 50. A second pneumatic pressure supply passage 23 is formed in the lengthwise direction of the piston guide part 21 to transfer the pneumatic pressure supplied via the first pneumatic pressure supply passage 13*a* of the socket 13 and the check valve 14. Here, the second pneumatic pressure supply passage 23 does not penetrate the piston guide part 21. The end of the piston guide part 21 is sealed to prevent the second pneumatic pressure supply passage 23 from penetrating the piston guide part 21.

In addition, discharge holes 24 are formed in an outer surface of the end of the piston guide part 21 to distribute the pneumatic pressure. Each of the discharge holes 24 has opposite-end sectional areas decreasing away from its center to top and bottom sides of the piston guide part 21 for distributing the pneumatic pressure. Here, each of the discharge holes 24 may have a uniform sectional area section 24*a* at its center for distributing the pneumatic pressure. The piston guide part 21 is formed to extend from the sealing part 22 along a lengthwise central axis c of the main body 11, and discharge holes 24 are formed in the outer surface of the piston guide part 21 at the same height from the end of the piston guide part 21.

The second bushing member 30 is coupled to a lower portion of the main body 12 and is shaped of a cylinder. The bit unit 60 having a pneumatic pressure discharge hole 61 for discharging the pneumatic pressure is installed at an end of the second bushing member 30.

The bottom end of the piston hammer 50 is guided by the top end of the second bushing member 30. A pneumatic pressure discharge part 32 is formed on the inner surface of the second bushing member 30 guiding the bottom end of the piston hammer 50 to discharge the pneumatic pressure in the second chamber 200 to the pneumatic pressure discharge hole 61 of the bit unit 60 when the piston hammer 50 is moved upward. The pneumatic pressure discharge part 32 has a plurality of first passage parts 32*a* formed from its top surface in the lengthwise direction. A second passage part 32*b*, circumferentially recessed from the inner circumferential surface of the hollow guide part 31, is formed at the end of the first passage parts 32*a* to discharge the pneumatic pressure, that is, the air, in the second chamber 200 to the pneumatic pressure discharge hole 61 through the first passage parts 32*a* and the second passage part 32*b* when the piston hammer 50 is moved upward.

Tips (not shown) for performing excavation are formed at the bottom end of the bit unit 60 installed at the end of the second bushing member 30. A pneumatic pressure dividing discharge part 63 is formed on the bottom surface of the bit unit 60 to ensure sufficient discharge of the pneumatic pressure through the pneumatic pressure discharge hole 61. The pneumatic pressure dividing discharge part 63 is preferably formed in a radial shape to prevent the bit unit 60 from being moved upward by the pneumatic pressure discharged through the pneumatic pressure discharge hole 61. In order to reduce an area of the end of the bit unit 60 contacting the ground when the excavation is performed, the pneumatic pressure dividing discharge part 63 may have a groove formed on its bottom surface to be connected to the pneumatic pressure discharge hole 61. The groove may be formed to extend from the bottom surface to the outer surface of the bit unit 60.

As described above, the piston hammer 50 has the guide hole 51 formed therethrough at its center in the lengthwise direction to be capable of sliding along the main body 12 and the piston guide part 21 of the first bushing member 20. In addition, the bottom end of the piston hammer 50 has a relatively small diameter so as to be inserted into the hollow guide part 31 of the second bushing member 30 to then be guided. The bottom end of the piston hammer 50 is configured to block and to open/close the second passage part 32*b*, thereby sealing the second chamber 200 or discharging the air in the second chamber 200 to the pneumatic pressure discharge hole 61 through a second passage part 33.

In addition, the piston hammer 50 has the pneumatic pressure distribution part 70 formed to selectively supply, in conjunction with the socket 13, to the first or second chamber 100 or 200, the pneumatic pressure supplied through the discharge holes 24 of the piston guide part 21.

Figure 5:
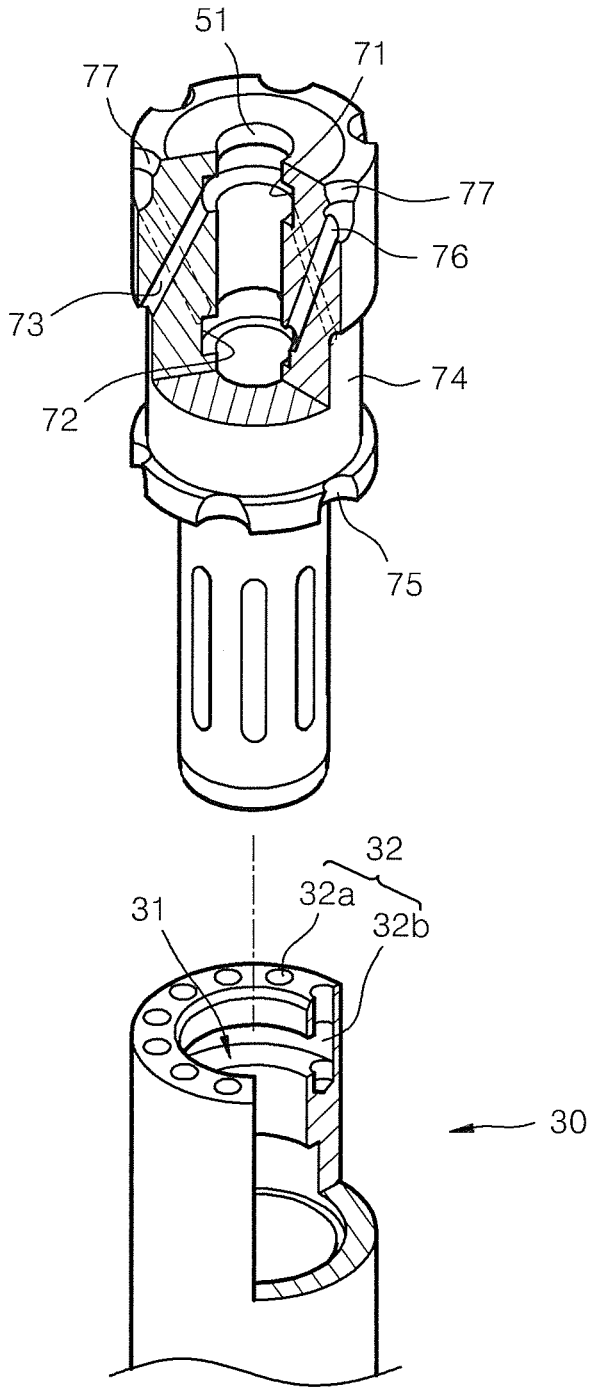
FIG. 5 is a partly cut-away extracted perspective view of a piston hammer and a second bushing member shown in FIG. 2.
Figure 6:
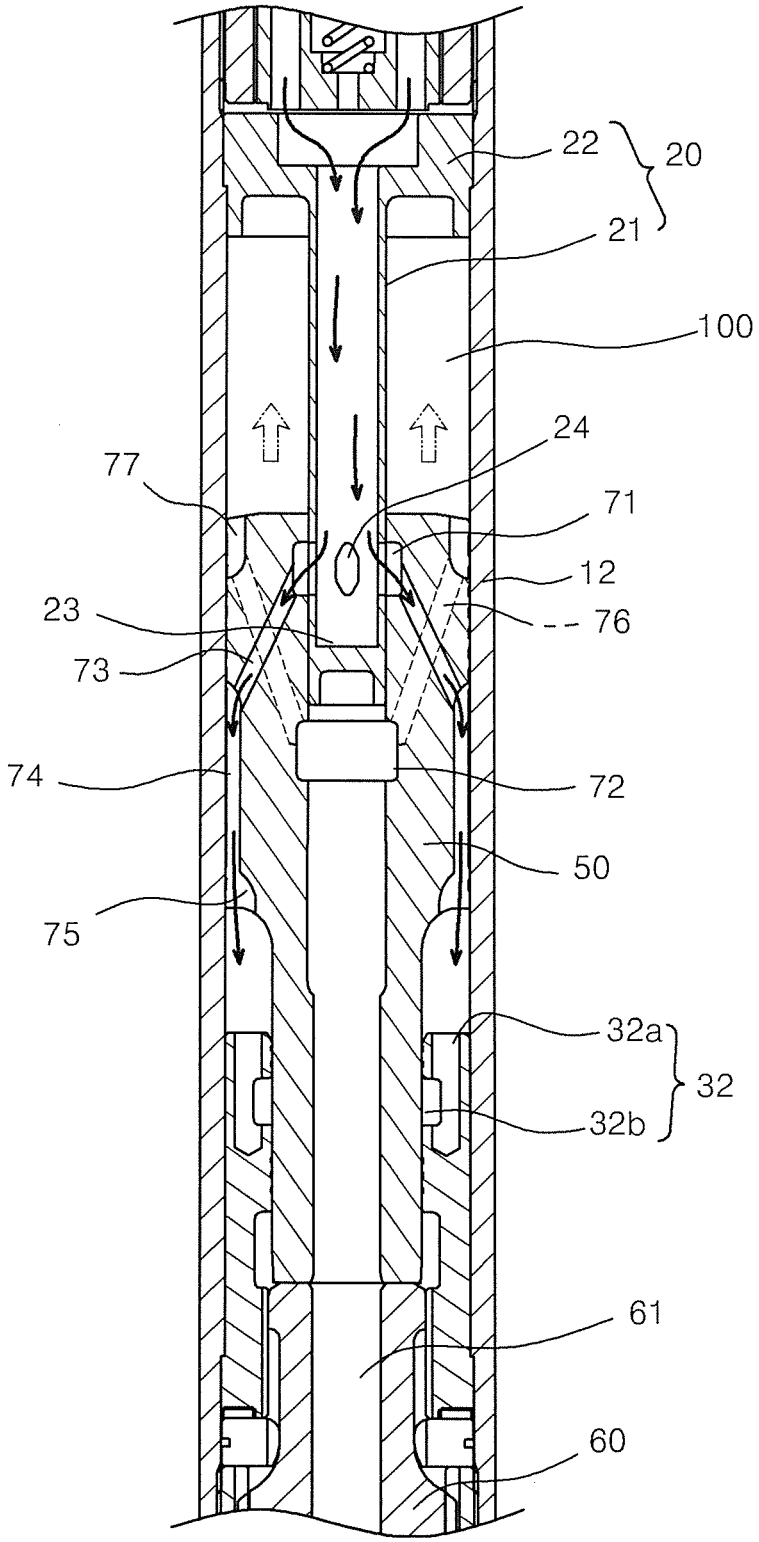
FIGS. 6 and 7 are cross-sectional views illustrating an operating state of the air hammer according to the present invention.
Figure 7:
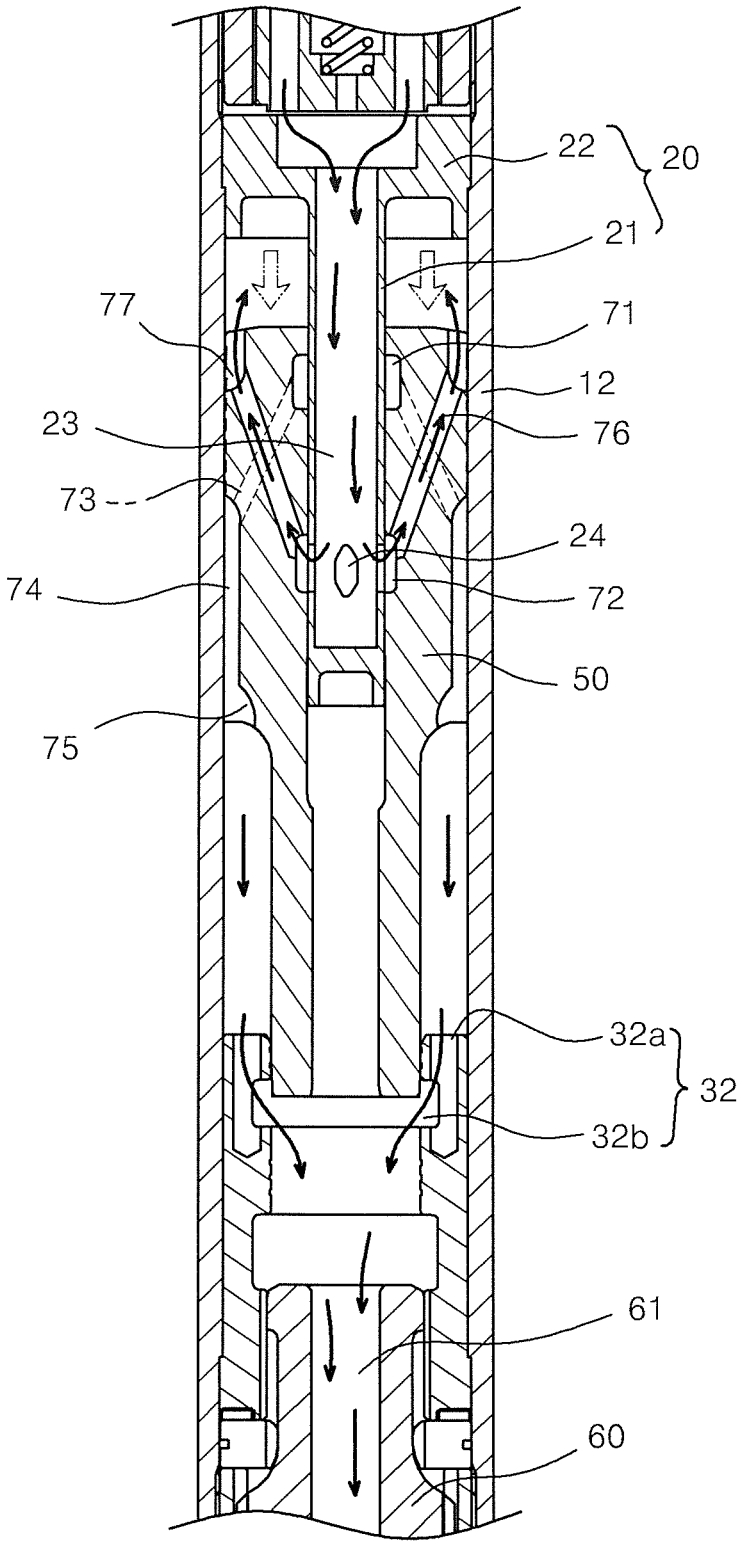

As shown in FIG. 5, the pneumatic pressure distribution part 70 has first and second distribution grooves 71 and 72 spaced apart a predetermined distance from each other on the inner circumferential surface of the guide hole 51 formed lengthwise. Each of the first and second distribution grooves 71 and 72 is shaped of a ring recessed from the inner surface of the first guide hole 51. The first and second distribution grooves 71 and 72 are formed to be perpendicular to the lengthwise direction of the guide hole 51.

The first distribution groove 71 is connected to a first distribution hole 73 penetrating the piston hammer 50 from the first distribution groove 71 to the outer circumferential surface of the piston hammer 50, the first distribution hole 73 connected to a connection groove 74 formed on the outer circumferential surface of the piston hammer 50 to communicate with the inner circumferential surface of the main body 12. A first distribution recess part 75 connecting the connection groove 74 with the second chamber 200 is formed on the outer circumferential surface of the piston hammer 50. Here, a sectional area of the first distribution recess part 75 is preferably smaller than that of the first distribution hole 73 to achieve air expansion in the first distribution recess part 75.

Therefore, the pneumatic pressure for upward moving the piston hammer 50 is supplied from the discharge holes 24 to the second chamber 200 through the first distribution groove 73, the connection groove 74 and the first distribution recess part 75.

The second distribution groove 72 is connected to a second distribution hole 76 upwardly penetrating the piston hammer 50 from the second distribution groove 72 to the outer circumferential surface of the piston hammer 50, the second distribution hole 76 formed on the outer circumferential surface of the piston hammer 50 to be connected to a second distribution recess part 77 to communicate with the first chamber 100. Therefore, the pneumatic pressure for downward moving the piston hammer 50 is supplied from the discharge holes 24 to the first chamber 100 through the second distribution groove 72, the second distribution hole 76 and the second distribution recess part 77. A sectional area of each of the first and distribution recess parts 75 and 77 is preferably smaller than that of each of the first and second distribution holes 73 and 76. An enlarged opening part may be formed at outlets of the first and second distribution recess parts 75 and 77, that is, at a connection part of the second chamber 200 and the first chamber 100.

As described above, the air hammer 10 according to the present invention performs a boring work in a state in which it is connected to the drive rod 6 connected to the head part 5 of the boring machine. The boring work is achieved by striking the bit unit 60 by supplying a high pneumatic pressure to the air hammer 10 through the drive rod 6 while rotating the air hammer 10 connected to the drive rod 6 by the head part 5.

The operation of the air hammer 10 is described as follows. The pneumatic pressure supplied through the drive rod 6 is applied to the check valve member 14*b* of the check valve 14 installed at the socket 13 to overcome an elastic force of the elastic member 14*c*, thereby downward moving the check valve member 14*b*. The pneumatic pressure is induced to the second pneumatic pressure supply passage 23 of the first bushing member 20 through the throughhole 14*e*.

The pneumatic pressure induced into the second pneumatic pressure supply passage 23 is supplied to the second chamber 200 through the discharge holes 24, the first distribution groove 71, the first distribution hole 73, the connection groove 74 and the first distribution recess part 75 in a state in which the piston hammer 50 is moved downward, thereby upward moving the piston hammer 50. During this procedure, since the first distribution recess part 75 has a smaller sectional area than the first distribution hole 73, the pneumatic pressure supplied to the second chamber 200 may be expanded, that is, adiabatically expanded, at the first distribution recess part 75, thereby preventing the piston hammer 50 from being brittle when the piston hammer 50 is rapidly cooled due to adiabatic expansion. Then, the piston hammer 50 is moved upward by supplying the pneumatic pressure to the second chamber 200 in the above-described manner.

When the piston hammer 50 is moved upward, the discharge holes 24 deviate from the first distribution groove 71. The discharge holes 24 are connected to the second distribution groove 72 when the piston hammer 50 reaches a top dead center. Here, the bottom end of the piston hammer 50 guided by the second bushing member 30 is moved upward to deviate from the second passage part 32*b*. Therefore, the pneumatic pressure of the second chamber 200 is discharged to the pneumatic pressure discharge hole 61 through the first passage part 32 and the second passage part 33.

Then, the pneumatic pressure is supplied to the first chamber 100 from the discharge holes 24 through the second distribution groove 72, the second distribution hole 76 and the second distribution recess part 77. During this procedure, since each of the discharge holes 24 has opposite-end sectional areas gradually decreasing away from its center to its top and bottom sides, the amount of the pneumatic pressure supplied, i.e., the air, gradually decreases, thereby gradually reducing a force for upward moving the piston hammer 50 and delaying a time required to reach a highest pressure point of the piston hammer 50.

Therefore, when the kinetic energy exerted when the piston hammer 50 is moved upward becomes a minimum level, a force of downward moving the piston hammer 50 is supplied to the piston hammer 50, thereby maximizing the kinetic energy exerted by downward moving the piston hammer 50, which will now be described in more detail. As the piston hammer 50 is moved upward, the discharge holes 24 are exposed to the second distribution groove 72 from their bottom ends. Since each of the discharge holes 24 has opposite-end sectional areas gradually decreasing away from the bottom side to the top side of the piston guide part 21, the amount of the air induced through the discharge holes 24 is not rapidly increased but is gradually increased, thereby preventing the pneumatic pressure in the first chamber 100 from rapidly reaching the highest pressure point. Further, the pneumatic pressure for downward moving the piston hammer 50 is made to reach the pressure highest point when the kinetic energy exerted when the piston hammer 50 is moved upward is minimized, thereby maximizing the force of downward moving the piston hammer 50.

As described above, since the pneumatic pressure of the second chamber 200 is discharged and the first chamber 100 has an increased internal pressure due to the air supplied thereto, the piston hammer 50 is rapidly moved downward to strike the bit unit 60.

As the above-described procedure is repeatedly performed, the piston hammer 50 is moved up and down to apply a continuous striking force to the bit unit 60, thereby achieving excavation.

In the course of performing excavation in the above-described manner, the air, i.e., the pneumatic pressure, discharged through the pneumatic pressure discharge hole 61 of the bit unit 60, may not be smoothly discharged due to tight adherence between the bottom surface of the bit unit 60 and the ground surface, upward moving the bit unit 60. However, according to the present invention, since the pneumatic pressure dividing discharge part 63 is formed on the bottom surface of the bit unit 60, it is possible to prevent a repulsive force from upwardly acting on the bit unit 60 due to the pneumatic pressure that is not discharged through the pneumatic pressure discharge hole 61 of the bit unit 60.

As described above, according to the present invention, the top and bottom ends of the piston hammer 50 are supported by the piston guide part 21 and the second bushing member 30, the piston hammer 50 can be supported in a secured manner when it is moved upward, and vibration of the piston hammer 50 can be suppressed. In addition, since each of the discharge holes 24 formed in the piston guide part 21 has opposite-end sectional areas gradually decreasing away from the center, it is possible to reduce the shock applied when the piston is rapidly moved upward.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined by the appended claims.

INDUSTRIAL APPLICABILITY

The air hammer according to the present invention can be widely used to create various types of underground bores.

What is claimed is:

1. An air hammer for a boring machine comprising:

a main body including a hollow portion;

a socket coupled to a side of the main body;

a first bushing member including a sealing part coupled to the main body and a piston guide part extending from the sealing part in parallel with a lengthwise central axis of the main body and defining an air supply passage and discharge holes in an outer surface thereof to communicate with the air supply passage;

a second bushing member installed at an end on the opposite side of the main body;

a bit unit installed at an end of the second bushing member;

a piston hammer, top and bottom ends of which are supported by the guide part and the second bushing member so as to be moved up and down, the piston hammer having a guide hole formed therethrough in the lengthwise direction and partitioning a main body compartment between the first and second bushing members into first and second chambers;

a pneumatic discharge part formed at the top end of the second bushing member supporting the bottom end of the piston hammer to discharge the air in the second chamber when the piston hammer is moved upward; and a pneumatic pressure distribution part formed on the piston hammer to selectively supply to the first or second chamber, in conjunction with the socket, the pneumatic pressure supplied through a pneumatic pressure supply passage and the discharge holes of the piston guide part of the first bushing member, wherein the pneumatic pressure distribution part includes first and second distribution grooves spaced apart a predetermined distance from each other on the inner circumferential surface of a guide hole formed lengthwise; the first distribution groove is connected to a first distribution hole penetrating the piston hammer from the first distribution groove to the outer circumferential surface of the piston hammer, the first distribution hole formed at a portion on the outer circumferential surface of the piston hammer to be connected to a connection groove to communicate with the inner circumferential surface of the main body, and the connection groove connected to the second chamber by a first distribution recess part formed on the outer circumferential surface of the piston hammer; and the second distribution groove is connected to a second distribution hole penetrating the piston hammer from the second distribution groove to the top end of the piston hammer, the second distribution hole formed on the outer circumferential surface of the piston hammer to be connected to a second distribution recess part communicating with the first chamber.

2. An air hammer for a boring machine comprising:

a main body including a hollow portion;

a socket coupled to a side of the main body;

a first bushing member including a sealing part coupled to the main body and a piston guide part extending from the sealing part in parallel with a lengthwise central axis of the main body and defining an air supply passage and discharge holes in an outer surface thereof to communicate with the air supply passage;

a second bushing member installed at an end on the opposite side of the main body;

a bit unit installed at an end of the second bushing member;

a piston hammer, top and bottom ends of which are supported by the guide part and the second bushing member so as to be moved up and down, the piston hammer having a guide hole formed therethrough in the lengthwise direction and partitioning a main body compartment between the first and second bushing members into first and second chambers;

a pneumatic discharge part formed at the top end of the second bushing member supporting the bottom end of the piston hammer to discharge the air in the second chamber when the piston hammer is moved upward; and a pneumatic pressure distribution part formed on the piston hammer to selectively supply to the first or second chamber, in conjunction with the socket, the pneumatic pressure supplied through a pneumatic pressure supply passage and the discharge holes of the piston guide part of the first bushing member, wherein the pneumatic pressure discharge part includes a plurality of first passage parts formed lengthwise from the top surface of a second bushing member having a hollow guide part, and the second bushing member includes a second passage part connected to an end of the first passage part in the circumferential direction along the inner circumferential surface of the hollow guide part.

* * * * *